US005413312A

United States Patent [19]

Bobel

[11] Patent Number: 5,413,312

[45] Date of Patent: May 9, 1995

[54] JACK DEVICE FOR POSITIONING PLANKS OR OTHER ARTICLES ON FRAMEWORK

[76] Inventor: Dennis B. Bobel, 5134 Simpkins Rd., Whites Creek, Tenn. 37189

[21] Appl. No.: 140,420

[22] Filed: Oct. 25, 1993

[51] Int. Cl.[6] ..... B66F 3/00

[52] U.S. Cl. ..... 254/15

[58] Field of Search ..... 254/11-17, 254/113-120, 131; 29/238

[56] References Cited

U.S. PATENT DOCUMENTS

| | | | |
|---|---|---|---|
| 274,838 | 3/1883 | Steineke | 254/15 |
| 2,948,507 | 8/1960 | Gould | 254/120 |
| 3,143,335 | 8/1964 | Lassahn | 254/11 |

*Primary Examiner*—Robert C. Watson
*Attorney, Agent, or Firm*—Rick R. Wascher

[57] ABSTRACT

The present invention is directed to a device for positioning planks or other articles which are to be set on a framework. The invention includes a platform having feet to stabilize the platform with respect to the framework. A connecting rod, a guide brace and a platen are all pivotally attached to the platform. The connecting rod has a proximal and distal end. The distal end of the connecting rod is attached to an end of the guide brace as well as the platen. The opposite end of the guide brace is pivotally attached to the platform. The proximal end of the connecting rod is pivotally attached to a handle assembly which in turn is pivotally connected to the platform. A rotational torque applied to the handle is transmitted by the handle assembly to the connecting rod which in turn causes the platen to apply a force to the plank or other article to be bent. An optional anti-reverse mechanism is pivotally attached to the platform and is biased into engagement with the connecting rod so that the connecting rod can be held in place and the handle assembly released when the plank or other article is to be set.

18 Claims, 4 Drawing Sheets

JACK DEVICE FOR POSITIONING PLANKS OR OTHER ARTICLES ON FRAMEWORK

BACKGROUND OF THE INVENTION

1. Field of the Invention

The present invention relates generally to devices for positioning plank or other articles to be set on framework such as joists, studs, framing, etc., but more particularly to devices that engage the framework while positioning the plank or other article to be set.

2. Description of the Related Art

There are numerous devices that comprise the art to which the present invention relates. Some of those devices include U.S. Pat. No. 5,139,231 granted to Temple, which is incorporated by reference as if fully set forth herein, and directed to a lumber jack. The Temple device engages the joist and bends a plank or other article by virtue of a fulcrum-like force applied to the plank or other article by a handle or lever.

U.S. Pat. No. 4,821,784 granted to Cone, which is incorporated by reference as if fully set forth herein, is directed to a tool for removing lateral deflection in a wood plank or other article. The Cone device engages the joist and uses a long moment arm for the plank or other article positioning force. As a rotational torque is applied to the handle of the device, the opposite end of the handle (moment arm) applies a force against the plank or other article to be bent.

Yet another device partially comprising the art to which the invention relates is U.S. Pat. No. 396,104 granted to Morrill, which is incorporated by reference as if fully set forth herein, and directed to a floor clamp. The Morrill device uses a ratchet and pawl mechanism to maintain a constant force applied to the plank or other article to be bent and set on a joist.

Other patents of interest contained in the art to which the invention relates are listed in the following table.

| | |
|---|---|
| Staskiewicz et al. | 4,621,791 |
| Waters Jr. | 4,620,691 |
| Brown | 4,266,586 |
| Fernandez | 3,939,546 |
| Campbell | 3,524,623 |
| Schwartz | 3,331,584 |
| Pitsenbarger | 3,203,668 |
| Jones | 2,823,011 |
| Ham | 2,780,437 |
| Warner | 2,625,368 |
| Mansir | 2,351,691 |
| Fleming | 2,427,268 |
| McMullan | 1,911,705 |
| Buehler | 889,104 |
| Early | 721,681 |
| Clough | 32,120 |

SUMMARY OF THE PRESENT INVENTION

The invention is a device useful for positioning plank or other articles to be set on a joist or beam having a longitudinal axis. The device comprises a platform having a foot means in the nature of spaced apart angularly offset feet, for stabilizing the platform with respect to the joist on which the plank or other article is to be set. The invention also includes a jack means and a handle means.

The platform is substantially planar, preferably metal plate which rests atop the joist on which the plank or other article is to be set.

In the preferred embodiment, the spaced apart feet are pivotal and extend perpendicularly from the bottom surface of the platform. As mentioned above, the feet are offset in alignment such that when the plate is turned in a counterclockwise direction the feet engage the sides of the joist in order to stabilize the platform.

The jack means is pivotally attached to the platform, and includes a connecting rod, a guide brace and a platen. The connecting rod has a proximal and distal end. The guide brace has spaced apart ends.

The distal end of the connecting rod and an end of the guide brace are pivotally connected to the platen. The opposing end of the guide brace is pivotally connected to the platform. The proximal end of the connecting rod is pivotally connected to a handle means.

The preferred handle means includes a longitudinal handle attached to a handle mount having an aperture formed therethrough to enable the handle to reciprocate therein for compact transportation. In use, however, the handle extends like a moment arm from the handle mounts.

A rotational torque applied to the handle mount by the handle is thereby transferred to the connecting rod by virtue of a handle mount and connecting rod pivot. The rotational torque transmitted by the connecting rod is transformed into a substantially straight line force into the board to be positioned by virtue of the guide brace. The platen, therefore, is the means by which the connecting rod transfers the force to the board. The platen, therefore, has a board contacting surface for this purpose.

In the preferred embodiment, an optional biasing means may be included with the present invention. The preferred biasing means incorporates a pawl component having a pawl tip and a pawl pivot. The pawl component pivots on the pawl pivot and is biased toward the connecting rod by virtue of a biasing spring. The tip of the pawl is configured to engage a serrated edge of the connecting rod. In this fashion, a force applied to the board can be held and maintained if the pawl is engaged with the serrated edge of the connecting rod such that the pawl tip prevents the connecting rod from traversing in a direction opposite of the force applied positioning direction.

In use, the user positions the platen such that the spaced apart feet straddle a joist or beam. The offset nature of the feet enable the user to apply a rotational torque to the invention by way of the handle. The offset spaced apart feet then bind against the joist on which the platform is positioned. The user may continue to apply a rotational torque on the handle to cause the connecting rod to advance in the board positioning direction.

At this point, the biasing means and the spring holds the tip of the pawl in communication with the teeth of the connecting rod.

In the preferred embodiment, the invention has the inherent capability to vary the separation distance of the feet to enable the invention to be used with various sizes of joists or beams.

Furthermore, it is also contemplated that a variety of differently sized and configured platens may be used for special applications.

It is also contemplated that a variety of rotational torque inducing means such as power assist means, as well as other biasing means of various configurations may be used and still maintain the spirit and scope of the present invention such that the connecting rod is prevented from traveling in a direction opposite the force applying direction into the board to be positioned.

DESCRIPTION OF THE PREFERRED EMBODIMENTS

Figure 1:
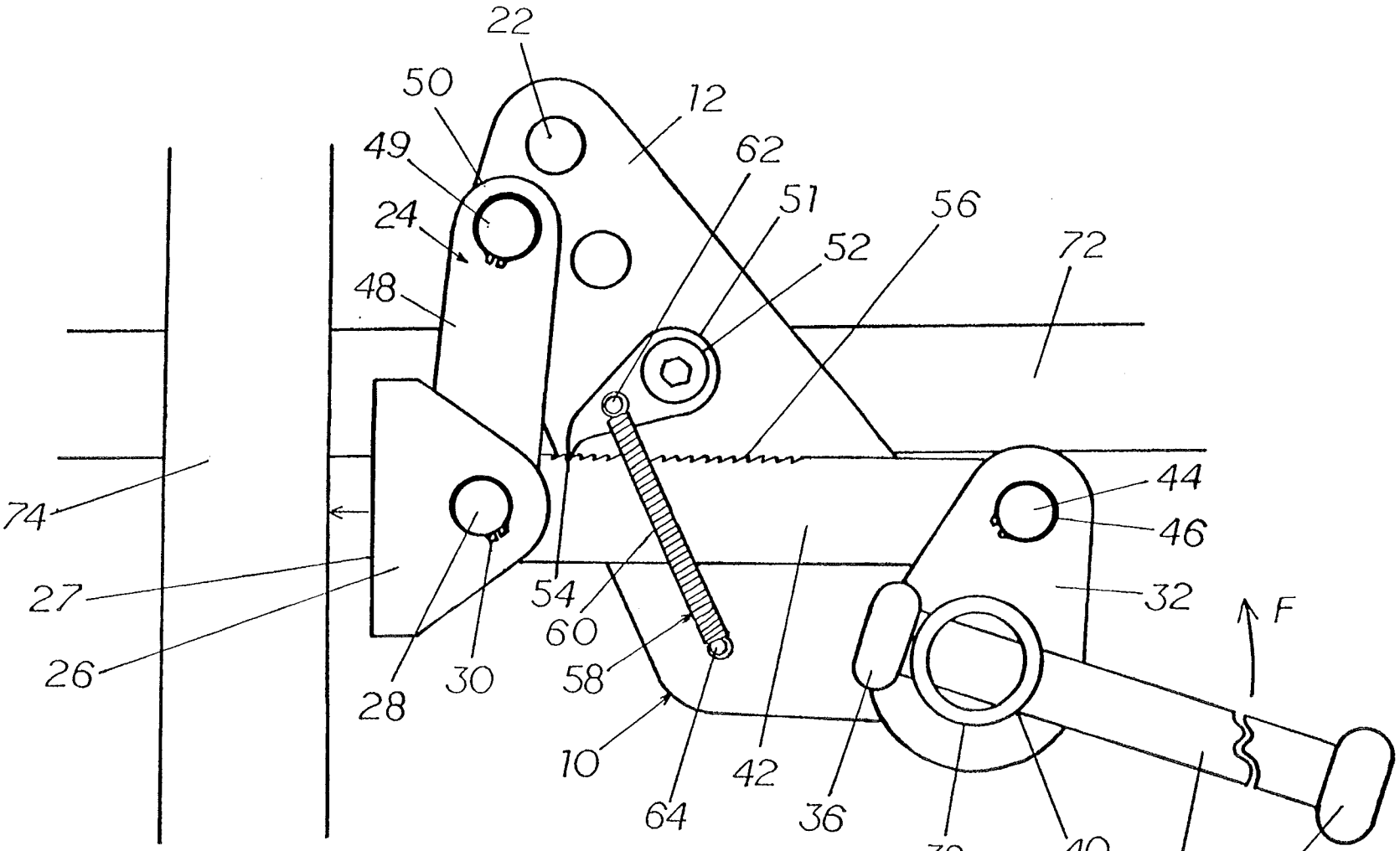
FIG. 1 is an elevated perspective view of the invention.
Figure 2:
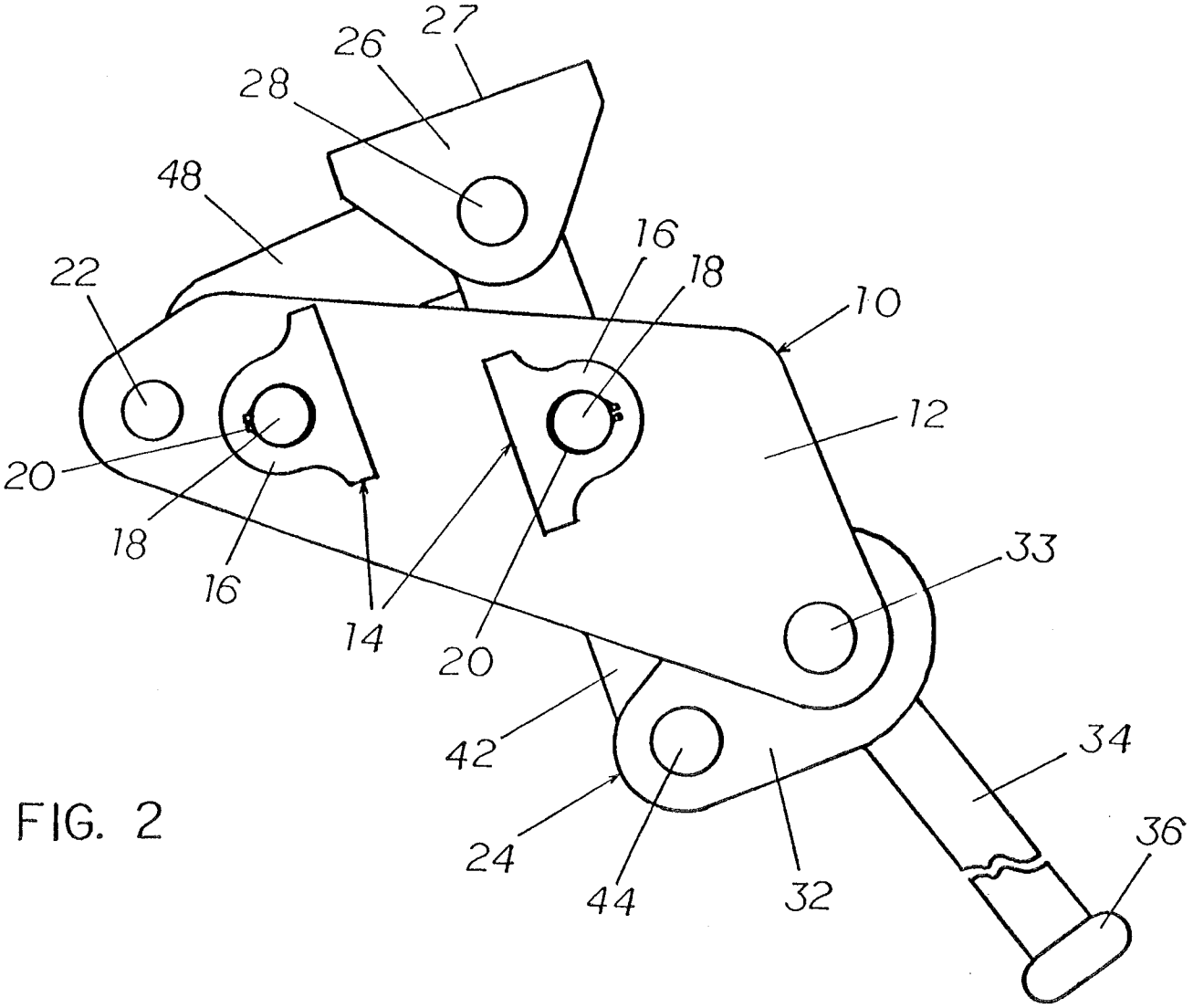
FIG. 2 is a bottom perspective view of the invention shown in FIG. 1.
Figure 3:
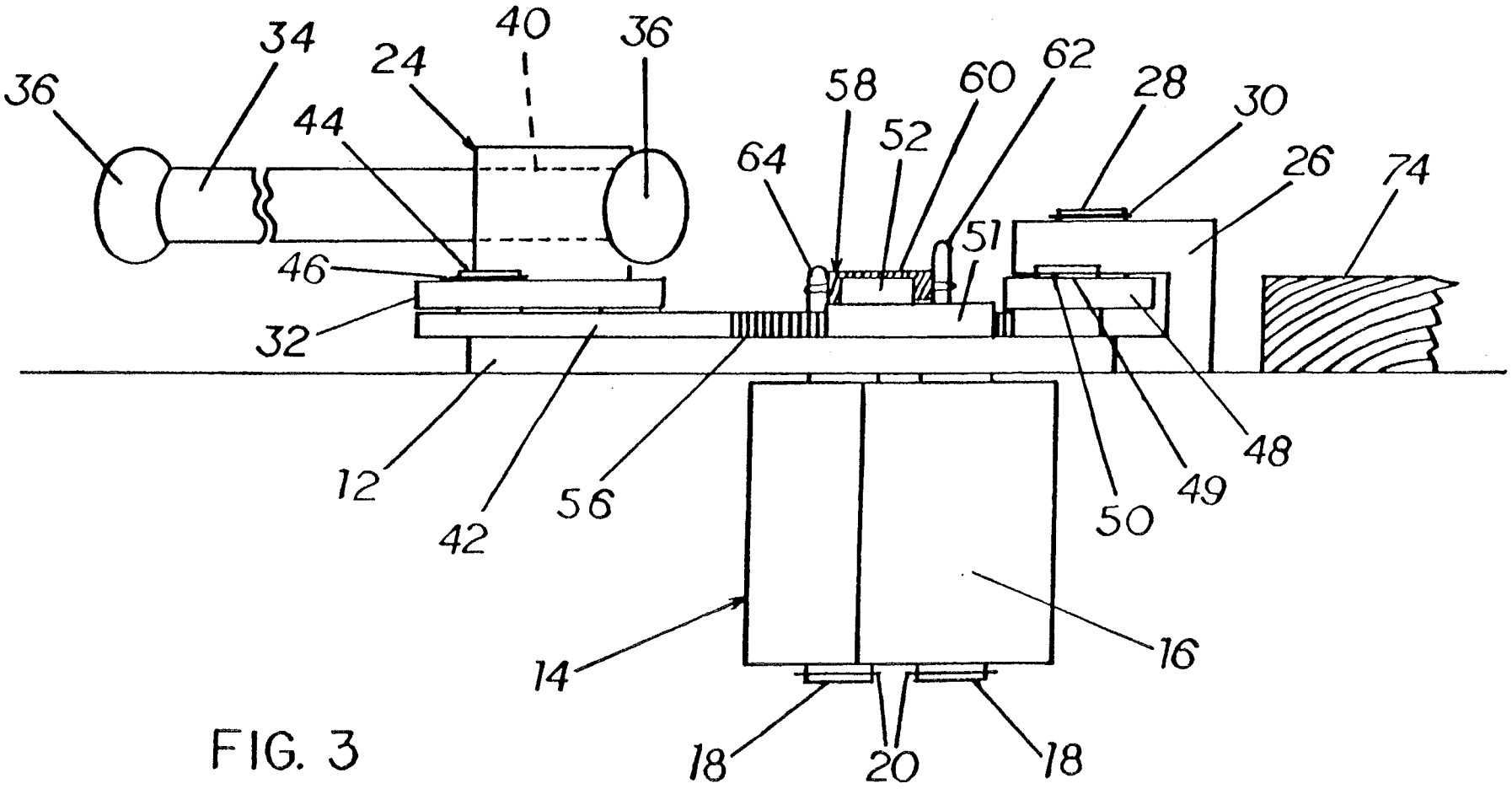
FIG. 3 is side perspective view of the invention shown in FIGS. 1 and 2.

With reference to FIGS. 1 through 3 an embodiment of the present invention is designated generally by the reference numeral 10. An embodiment of the invention 10 includes a platform 12, and feet 14 which extend perpendicularly from the bottom surface of the platform. The feet are composed of shoes 16 and pivot axis 18 which is actually a shaft of rotation for the shoes 16. The shoes 16 are held to the shaft 18 by means of retaining rings 20 (FIG. 2). Optional bores 22 (FIGS. 1 and 2) are provided to enable the feet to be repositioned on the platform to accommodate joists and beams of varying sizes.

Figure 4:
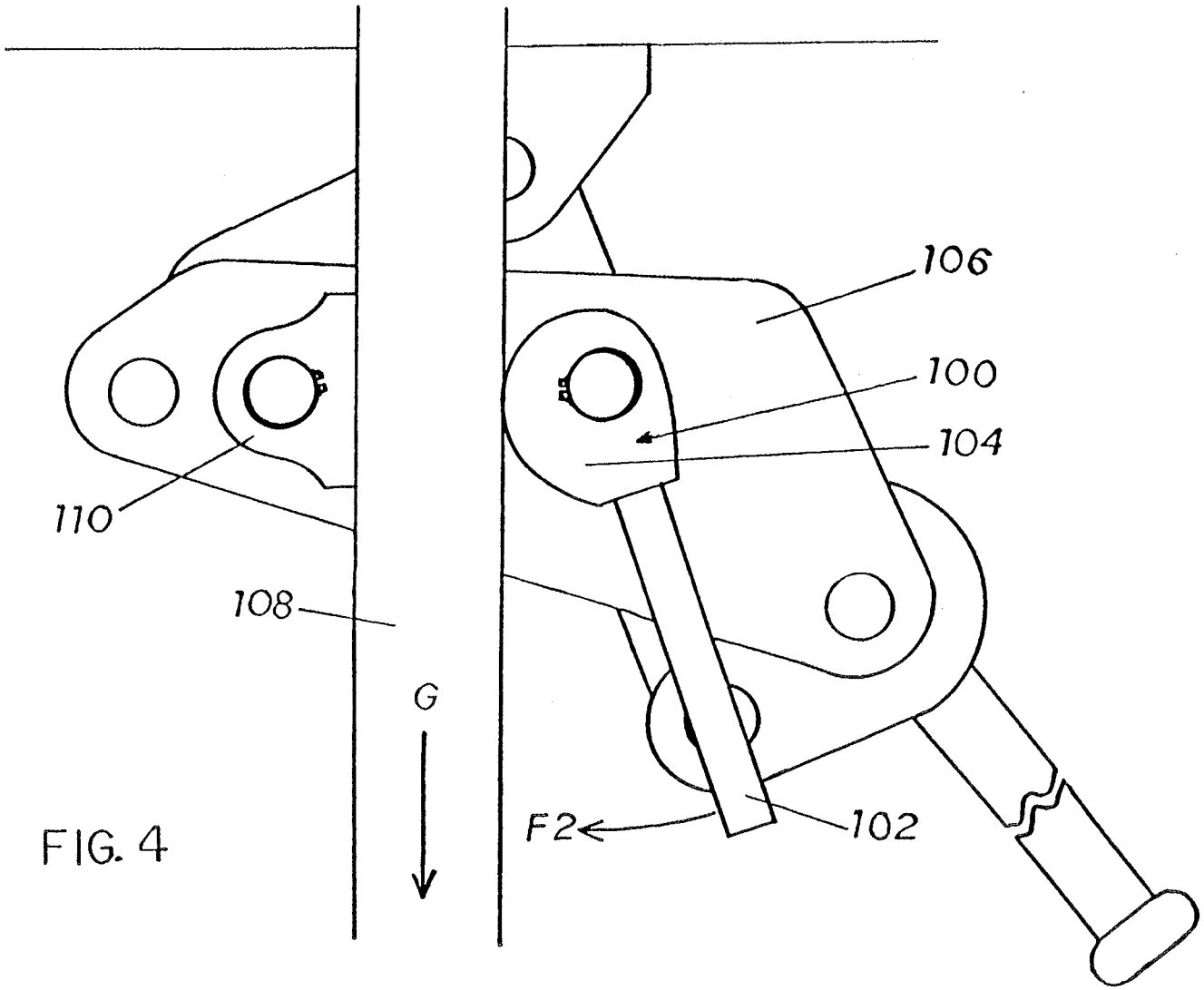
FIG. 4 is a bottom perspective view of an alternate embodiment of the invention shown in FIGS. 1–3.

In an alternate embodiment of the present invention shown in FIG. 4, a cam foot designated generally by the reference numeral 100 may be useful in applications where the invention is aligned vertically.

Cam foot 100 includes lever 102, and shoe 104 pivotally attached to the platform 106. The user simply positions the invention on a stud or rafter 108 and moves lever 102 in the direction of the force arrow F2 to bind the feet 104 and 110 to the rafter or stud 108. The invention is then held in place with the binding force and gravity, because gravity tends to allow the ivention fall downward along the rafter or stud in the direction of the arrow G.

The direction of fall and the contact of foot 104 on the stud or rafter 108 tends to cause the foot 104 and lever 102 to move in the direction of the arrow F2 and keep the feet 104 and 110 of the invention in binding contact with the stud or rafter 108 to minimize slippage of the invention therewith.

Attached and pivotally mounted to the platform is a jack assembly designated generally by the reference numeral 24. The jack assembly 24 includes a platen 26 having a plank or other article contacting driving surface 27 which is designed to apply a force to the board to be positioned. The platen 26 pivots with respect to a shaft 28 and is held in place therewith by virtue of, for example, by split ring 30. The jack assembly 24 also includes a connecting rod 42 and guide brace 48 which will be described hereinbelow.

Handle mount 32 has an axis of rotation 33 (FIG. 2). Handle 34 has a pair of spaced apart caps 36 which enable it to reciprocate freely within the apertures 40 of the cylinder 38 by virtue of the communication of the handle 34 therein.

Cap members 36 prevent the handle from being fully withdrawn from the cylinder of the handle mount 32. Handle mount 32 has a connecting rod pivot 44. The handle mount is attached to the pivot point 44 by virtue of a spring ring 46 (FIG. 1). The pivot enables the connecting rod 42 to receive an applied force. The force is applied to the connecting rod 42 by the handle 34 and handle mount 32 when a rotational torque is applied to the handle 34 in the direction of the letter F as shown in FIG. 1. The substantially bi-directional travel of the connecting rod is achieved by the guide brace 48.

Guide brace 48 has spaced apart ends, one of which is pivotally attached to the platform 12 and the other to the distal end of the connecting rod 42 and the platen 26.

An optional catch or anti-reverse assembly is comprised of a pawl 51, pivotal with respect to the platform 12 at pivot 52. Tip 54 of the pawl 51 is designed to engage the teeth 56 of the connecting rod 42. Biasing means 58, in the preferred embodiment a spring 60, is attached to posts 62 and 64 to maintain the pawl tip 54 in engagement with the teeth 56.

MODE OF OPERATION

In use, the invention is placed on joist or beam 72 with the platen surface 27 adjacent the plank or other article to be positioned 74. A rotational torque is applied to the handle 34 in a direction indicated by the letter "F" in FIG. 1 and the shoes 16 of the feet 14 abut the joist 72. The applied rotational torque is allowed to be transmitted to the connecting rod 42 because handle mount 32 is pivotally connected to the platform 12 by virtue of pivot 33.

Guide brace 48 maintains the connecting rod in relative alignment with the joist and directs the rotational torque transferred to the connecting rod into a force directed substantially toward the beam 74. Accordingly, the rotational torque F applies a force to the connecting rod 42 by virtue of its pivot connection 44.

The platen 26 therefore, is allowed to pivot so that the contact surface 27 lies flush against plank or other article 74. When the force applied to the handle 34 and transferred to the connecting rod 42 is sufficient to position the plank or other article 74 a predetermined amount, the handle 34 may be released.

The anti-reverse mechanism, by virtue of its pawl and ratchet configuration 51 and 56, prevents the connecting rod from traveling in a rearward direction in response to the force applied to the platen by virtue of the potential energy of the bent board. The carpenter or builder may then set the plank or other article to the joist by any conventional means such as nailing or any other suitable manner.

After the plank or other article is set, the invention may be removed from the joist simply by rotating the handle in a direction opposite the arrow designated by the letter "F" and removing the invention from its operable position on the joist.

These and other embodiments of the present invention will become apparent in light of the enclosed specification including the drawings, as well as the claims appended hereto.

What is claimed is:

1. A device useful for positioning planks or other articles to be seet on framing including a frame segment having a longitudinal axis, the device comprising:

a platform;

foot means attached to and extending from the platform for stabilizing the platform with respect to a frame segment;

jack means, pivotally attached to the platform and operable in a direction parallel to the longitudinal axis of the frame segment, for exerting a force on a plank or other article to be positioned;

handle means for transmitting a rotational torque in a plane parallel to the platform to the jack means;

the jack means further comprises a connecting rod pivotally attached to the handle means, a pivotal platen connected to the connecting rod and a guide rod pivotally connected to the connected rod and the platform.

2. The device of claim 1 wherein the foot means further comprises a pair of spaced apart rotatable feet positioned to straddle the frame segment.

3. The device of claim 1 wherein the guide brace is pivotal with respect to the platen and connecting rod, and the platen is pivotal with respect to the connecting rod and guide brace.

4. The device of claim 1 further comprising anti-reverse means for maintaining the jack means in an operable plank or other article positioning position.

5. The device of claim 4 wherein the anti-reverse means comprises a cooperating ratchet and pawl configuration.

6. The device of claim 5 wherein the pawl is biased into an operable position.

7. The device of claim 1 wherein the foot means comprises at least two feet and one of such feet is a cam foot.

8. A device useful for positioning plank or other articles to be set at with respect to framework, wherein the device comprises:

a platform;

a pair of feet rotatably attached to the platform to stabilize the platform with respect to the framework;

jack means for positioning a plank or other article and including a guide brace having spaced apart ends, a connecting rod having a proximal and distal end, and a platen pivotally connected to the distal end of the connecting rod and an end of the guide brace, wherein the other end of the guide brace is pivotally connected to the platform; and handle means for applying a rotational torque to the proximal end of the connecting rod.

9. The device of claim 8 further comprising anti-reverse means or maintaining the jack means in a force applying position.

10. The device of claim 9 wherein the anti-reverse means comprises a cooperating ratchet and pawl configuration.

11. The device of claim 10 wherein the pawl is biased into an operable position.

12. The device of claim 8 wherein the feet are rotatably attached to the platform and positioned to straddle the framework.

13. The device of claim 8 wherein one of the pair of feet is a cam foot.

14. A device for positioning plank or other articles to be set on framework, comprising:

a platform;

means attached to the platform for stabilizing the platform with respect to a framework;

a connecting rod having a proximal and distal end;

a guide brace having first and second ends;

a platen pivotally engaged with the second end of the guide brace and distal end of the connecting rod;

handle means pivotally attached to the platform and the proximal end of the connecting rod;

wherein a rotational torque applied to the handle means is transferred to the platen to bend a plank or other article.

15. The device of claim 14 further comprising anti-reverse means for maintaining the jack means in an operable plank or other article positioning position.

16. The device of claim 15 wherein the anti-reverse means comprises a cooperating ratchet and pawl configuration.

17. The device of claim 16 wherein the pawl is biased into an operable position.

18. The device of claim 14 wherein the means for stabilizing rotatably attached to the platform and positioned to straddle the framework.

* * * * *